US012178301B2

(12) United States Patent
Wojczak et al.

(10) Patent No.: US 12,178,301 B2
(45) Date of Patent: Dec. 31, 2024

(54) GLASS HAIR STYLING IRON WITH HEAT AND LIGHT EMITTING SOURCE

(71) Applicant: CONAIR CORPORATION, Stamford, CT (US)

(72) Inventors: Sophia Wojczak, Harrison, NY (US); Paul James Carrubba, Baldwin, NY (US); Daniel Bishop, Trumbull, CT (US)

(73) Assignee: Conair LLC, Stamford, CT (US)

( * ) Notice: Subject to any disclaimer, the term of this patent is extended or adjusted under 35 U.S.C. 154(b) by 303 days.

(21) Appl. No.: 17/121,058

(22) Filed: Dec. 14, 2020

(65) Prior Publication Data

US 2022/0183437 A1 Jun. 16, 2022

(51) Int. Cl.

| | |
|---|---|
| ***A45D 1/16*** | (2006.01) |
| ***A45D 1/04*** | (2006.01) |
| ***A45D 1/28*** | (2006.01) |

(52) U.S. Cl.

CPC ..... *A45D 1/16* (2013.01); *A45D 1/04* (2013.01); *A45D 1/28* (2013.01); *A45D 2200/205* (2013.01)

(58) Field of Classification Search

CPC ... A45D 1/02; A45D 1/16; A45D 1/28; A45D 2200/205

See application file for complete search history.

(56) References Cited

U.S. PATENT DOCUMENTS

| | | | | |
|---|---|---|---|---|
| 2,688,971 A | | 9/1954 | Daniels et al. | |
| 3,157,184 A | * | 11/1964 | Lee | A45D 1/28 219/241 |
| 4,602,143 A | * | 7/1986 | Mack | A45D 1/28 219/241 |
| 4,740,669 A | | 4/1988 | Takimae | |
| 4,939,340 A | | 7/1990 | Brill | |
| 6,363,215 B1 | | 3/2002 | Cafaro | |
| 6,378,225 B1 | | 4/2002 | Slingo | |

(Continued)

FOREIGN PATENT DOCUMENTS

| | | | |
|---|---|---|---|
| CN | 207202398 | * | 4/2018 |
| CN | 207202398 U | | 4/2018 |

(Continued)

OTHER PUBLICATIONS

Machine translation of Chen refernece submitted with IDS of Dec. 4, 2020.*

(Continued)

*Primary Examiner* — Rachel R Steitz
*Assistant Examiner* — Brianne E Kalach
(74) *Attorney, Agent, or Firm* — Grogan, Tuccillo & Vanderleeden LLP

(57) ABSTRACT

A hair styling iron includes a housing, a mandrel extending longitudinally from the housing, the mandrel having a proximal end adjacent to the housing, and a distal end opposite the proximal end, and a plurality of light emitting elements within the mandrel. The plurality of light emitting elements are light emitting diodes that emit light having a wavelength between about 620 to about 750 nm. A cross-sectional area of the mandrel at the proximal end is greater than the cross-sectional area of the mandrel at the distal end.

20 Claims, 15 Drawing Sheets

(56) References Cited

U.S. PATENT DOCUMENTS

| | | | | |
|---|---|---|---|---|
| 6,423,942 | B1 * | 7/2002 | Liao | A45D 1/04 132/229 |
| 7,550,136 | B2 | 6/2009 | Warner et al. | |
| 8,286,645 | B2 * | 10/2012 | Kyu | A45D 2/36 132/118 |
| D672,501 | S | 12/2012 | Kim | |
| 8,387,271 | B2 | 3/2013 | Shami et al. | |
| D785,243 | S | 4/2017 | Zhang | |
| D865,871 | S | 11/2019 | Fernandez-Katz | |
| 10,588,391 | B2 | 3/2020 | Palero et al. | |
| D886,374 | S | 6/2020 | Hein et al. | |
| 10,684,073 | B2 | 6/2020 | Ku | |
| 2004/0159002 | A1 | 8/2004 | Carlucci et al. | |
| 2012/0060858 | A1 | 3/2012 | Bickford et al. | |
| 2015/0296950 | A1 * | 10/2015 | Everett, Jr. | A45D 2/001 132/269 |
| 2018/0036553 | A1 | 2/2018 | Shiibashi et al. | |
| 2020/0128935 | A1 | 4/2020 | Turner | |

FOREIGN PATENT DOCUMENTS

| | | | |
|---|---|---|---|
| DE | 2720961 | A1 | 11/1978 |
| IN | 201504727 | U | 6/2010 |
| KR | 101470169 | * | 12/2014 |
| WO | WO 2006018701 | * | 2/2006 |
| WO | WO 2004091335 | * | 10/2014 |
| WO | 2020095515 | A1 | 5/2020 |

OTHER PUBLICATIONS

Translation of Tae Hyuk.*

PCT International Search Report dated Feb. 17, 2022 from corresponding International Application No. PCT/US2021/061374 filed Dec. 1, 2021.

* cited by examiner

GLASS HAIR STYLING IRON WITH HEAT AND LIGHT EMITTING SOURCE

FIELD OF THE INVENTION

The present invention relates generally to hair styling devices and, more particularly, to a hair styling iron that utilizes infrared radiation to heat strands of hair.

BACKGROUND OF THE INVENTION

A variety of hair styling and hair curling devices are known, many of which are based on the principle of coiling strands of hair around a heating unit. Heated styling irons (e.g., hair styling irons) are used to form hair to a wide variety of styles, such as curling hair to impart a curl that does not naturally occur or straightening hair to remove a kink or curl. For example, a circular or semicircular-shaped curl can be created by wrapping hair around the outer surface of a heated cylindrically shaped hair styling iron tip.

Conventional curling irons include a cylindrical curling mandrel that may or may not have a clamping member that fits about a portion of the mandrel. During use, the curling mandrel can be heated and a strand of hair is clamped against the mandrel by the clamping member. Hair can be curled by rotating the mandrel to cause the clamped hair to be wrapped around the mandrel. Heat applied to the mandrel can alter the texture of the hair so as to curl it. After a predetermined amount of time, the clamping member is moved away from the mandrel, and the curled hair is unwound. Some conventional devices include a motorized heated mandrel that can rotate to wind hair around the mandrel using an electric motor.

While existing curling irons are generally suitable for what is regarded as ordinary performance, there is room for improvement in terms of overall functionality and performance.

In view of the above, there is a need for a curling iron that utilizes infrared radiation to heat and curl strands of hair.

SUMMARY OF THE INVENTION

It is an object of the present invention to provide a hair styling iron.

It is another object of the present invention to provide a hair styling iron that heat strands of hair by means of infrared radiation or light.

It is another object of the present invention to provide a hair styling iron having a conical or tapered mandrel.

These and other objects are achieved by the present invention.

According to an embodiment of the present invention, a hair styling iron includes a housing, a mandrel extending longitudinally from the housing, the mandrel having a proximal end adjacent to the housing, and a distal end opposite the proximal end, and a plurality of light emitting elements within the mandrel. The plurality of light emitting elements are light emitting diodes that emit light having a wavelength between about 620 to about 750 nm. A cross-sectional area of the mandrel at the proximal end is greater than the cross-sectional area of the mandrel at the distal end.

According to another embodiment of the present invention, a hair styling iron includes a housing, a mandrel extending longitudinally from the housing, a first linear array of light emitting elements within the mandrel, a second linear array of light emitting elements within the mandrel. The first linear array and second linear array are parallel.

According to yet another embodiment of the present invention, hair styling iron includes a housing, a mandrel extending longitudinally from the housing, a first linear array of light emitting elements within the mandrel, and a second linear array of light emitting elements within the mandrel. first linear array and second linear array are angled with respect to one another such that the first linear array and the second linear array are not parallel.

According to yet another embodiment of the present invention, a hair styling iron includes a housing, a mandrel extending longitudinally from the housing, a light tube within the mandrel, and at least one light emitting element configured to emit light into the light tube.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
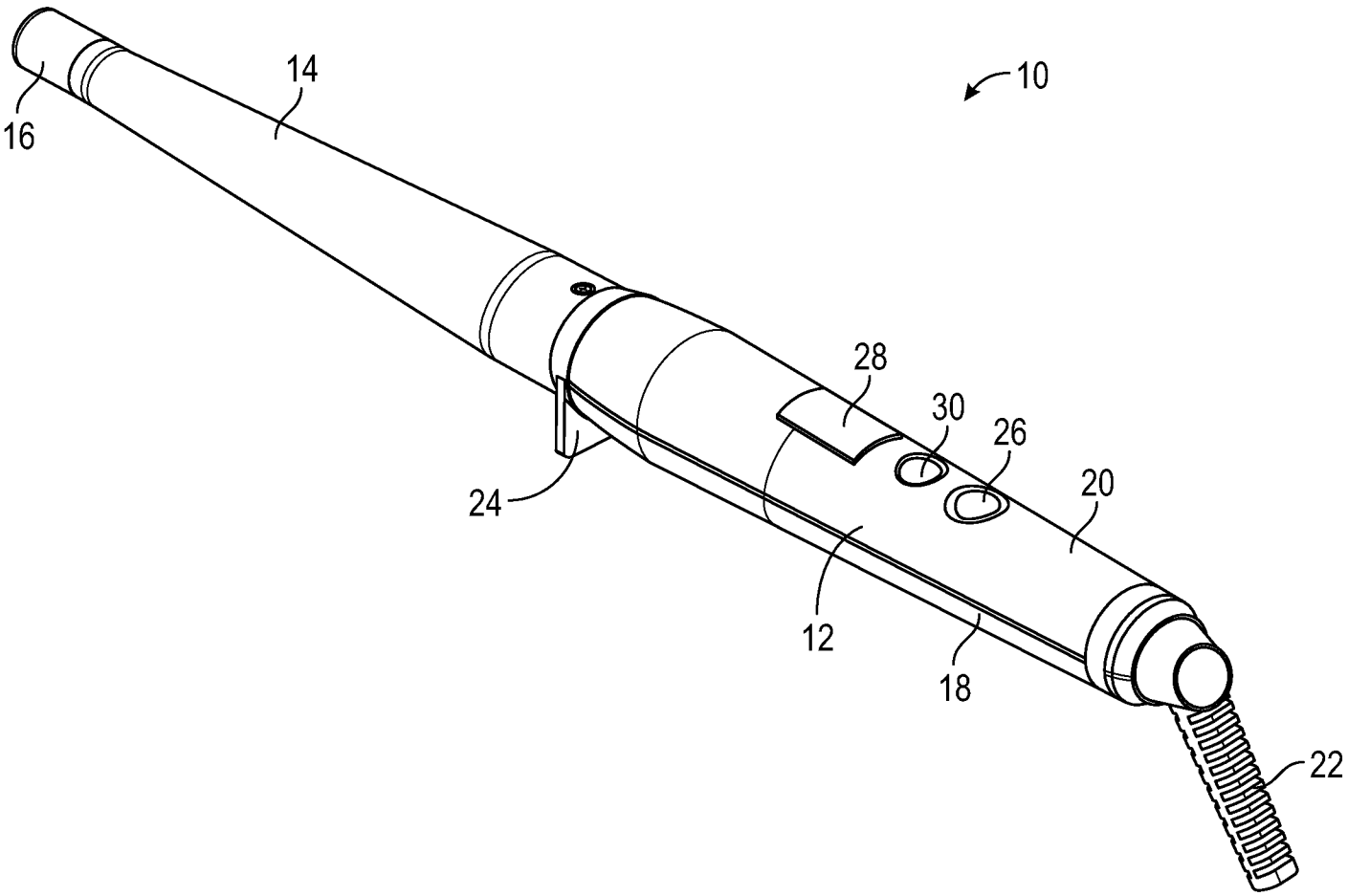
FIG. 1 is a perspective view of a hair styling iron according to an embodiment of the present invention.

With reference to FIGS. 1-4, a hair styling iron 10 (also referred to herein as curling iron 10) according to an embodiment of the present invention is illustrated. The hair styling iron 10 includes a housing or handle 12 and an elongate mandrel or barrel 14 extending from the housing 12 and terminating in a tip 16. As discussed hereinafter, the mandrel 14 is generally hollow and encloses at least one heat or light emitting element. In an embodiment, the mandrel 14 is generally conical in shape, having a larger diameter or cross-sectional area at a proximal end adjacent to the handle 12, and which narrows to a smaller diameter or cross-sectional area at the distal end adjacent to the tip 16. As shown in FIGS. 1-4, in an embodiment, the tip may be generally cylindrical, such that the taper of the device terminates at the end of the mandrel 14 prior to the tip 16. It is contemplated however, that the taper may also extend to the terminal, distal end of the device (i.e., including through the tip 16). In an embodiment, the tip 16 and mandrel 14 may be formed as a unitary component, although they may also be formed from discrete, separate components without departing from the broader aspects of the present invention.

While FIGS. 1-4 illustrate the mandrel 14 as being conical or tapered in shape, it is not intended that the present invention be so limited in this regard. In particular, in any of the embodiments disclosed herein, the mandrel 14 may take almost any shape including, for example, conical/tapered, cylindrical, stepped, wave, spiral, and the like. Importantly, the mandrel 14 is formed from a light and/or radiation transmissive material such as, for example, glass, the purpose of which will be disclosed hereinafter. In an embodiment, the mandrel 14 is transparent or translucent. In other embodiments, the mandrel 14 may be opaque, but may be formed from a material that allows for the passage of infrared radiation therethrough.

Figure 4:
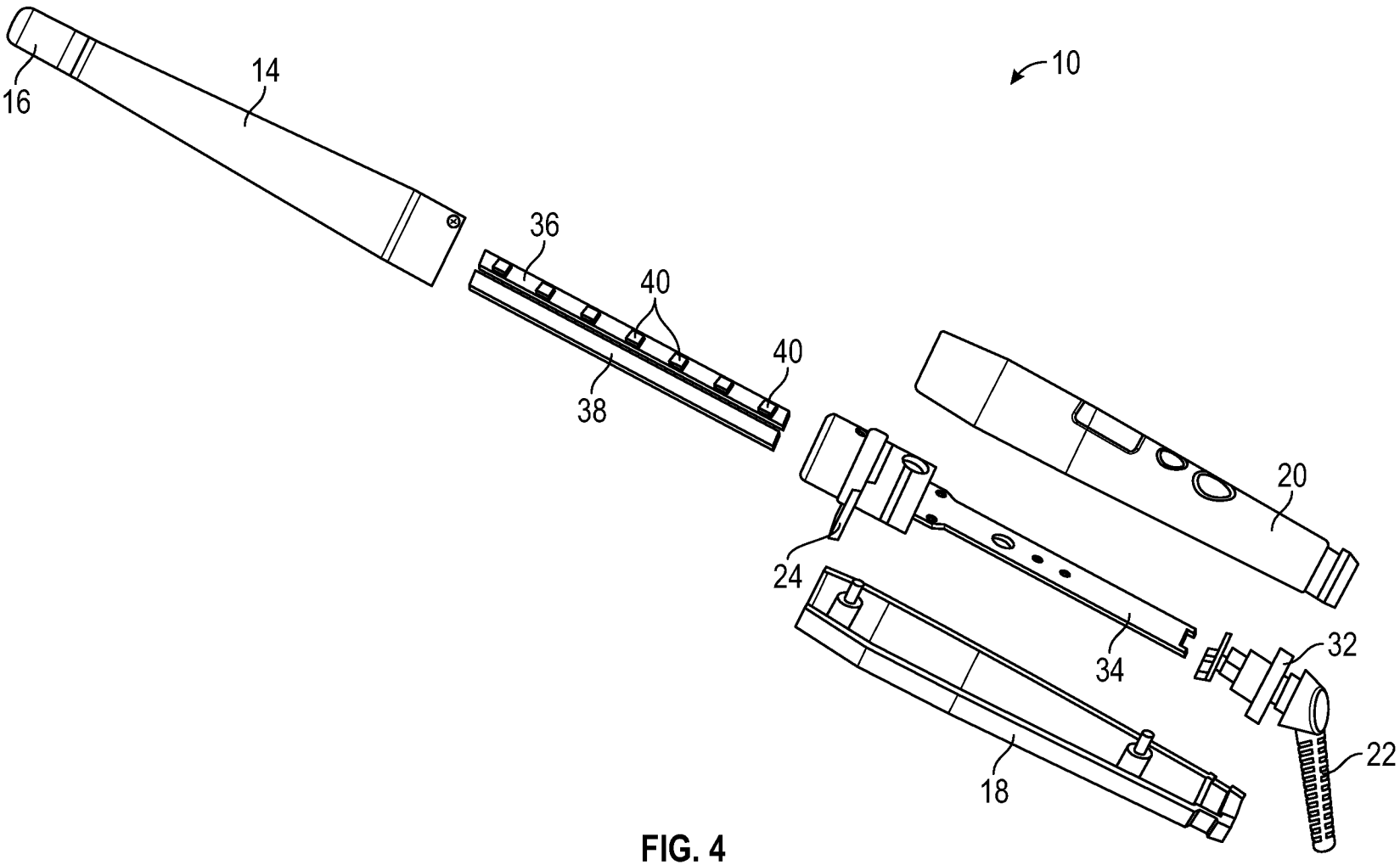
FIG. 4 is an exploded, perspective view of the hair styling iron of FIG. 1, showing a configuration of light emitting elements thereof according to an embodiment of the present invention.
Figure 5:
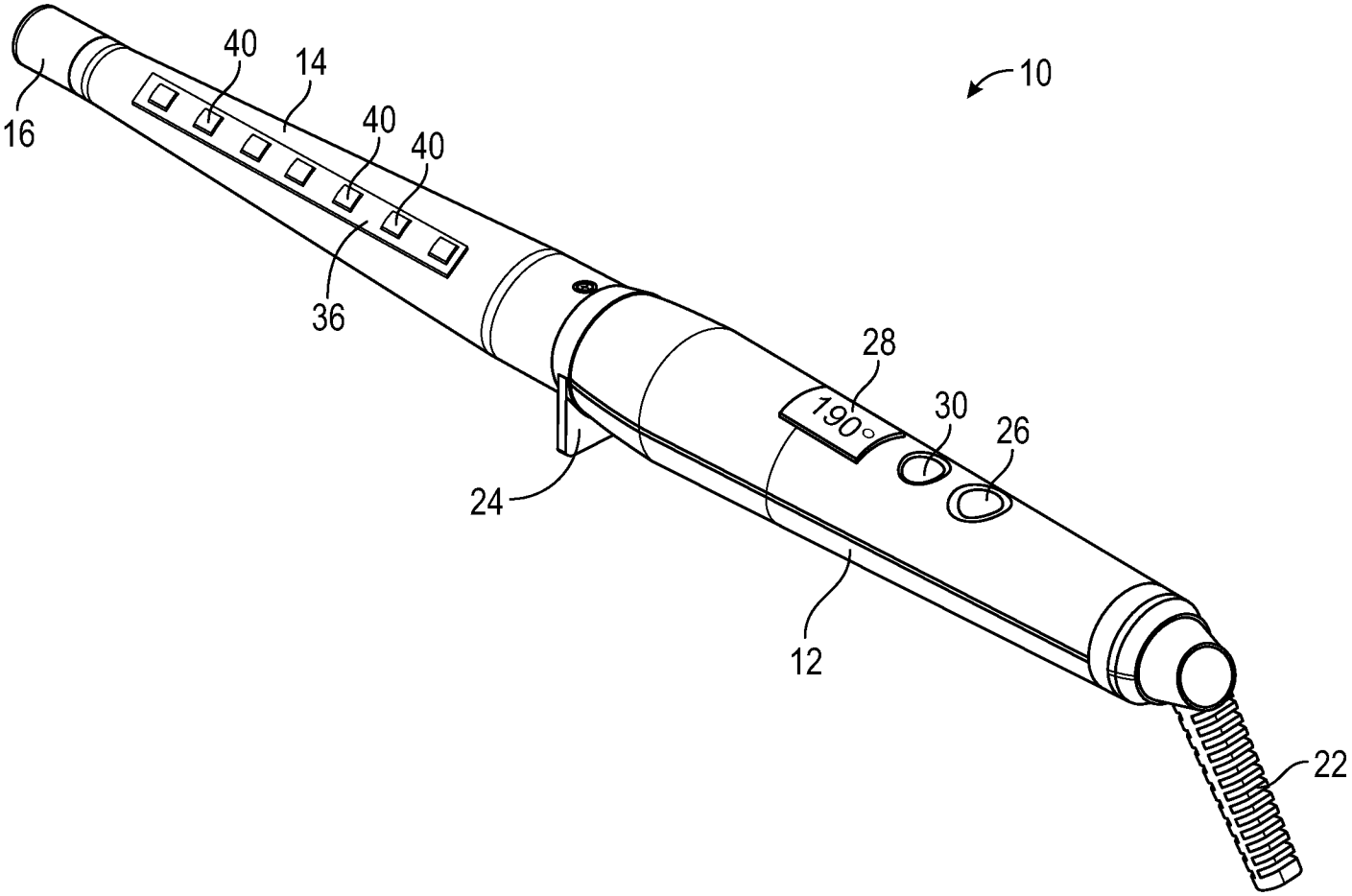
FIG. 5 is a rear, perspective view of the hair styling iron of FIG. 1, showing the location and orientation of the light emitting elements.
Figure 6:
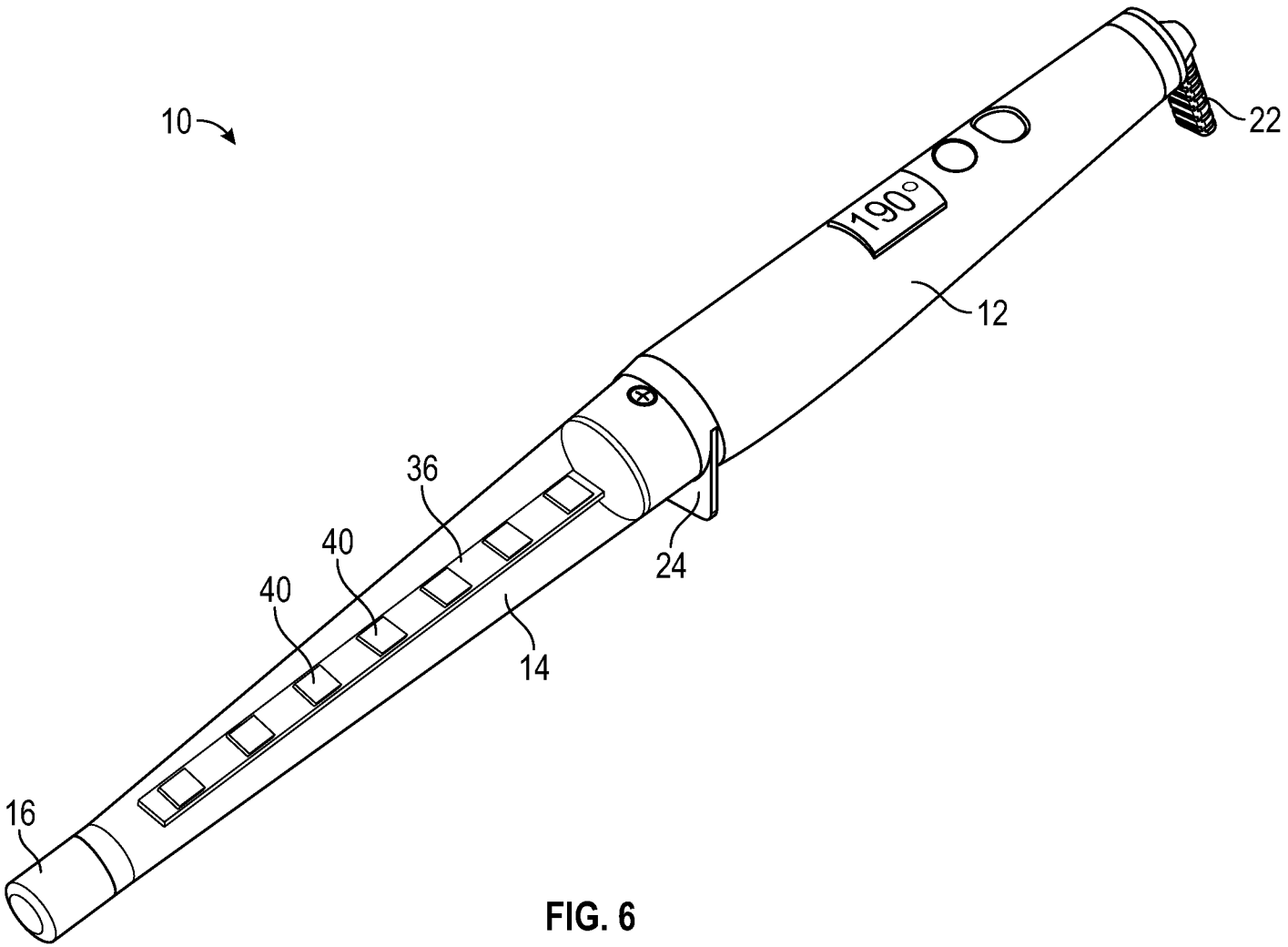
FIG. 6 is a front, perspective view of the hair styling iron of FIG. 1, showing the location and orientation of the light emitting elements.
Figure 7:
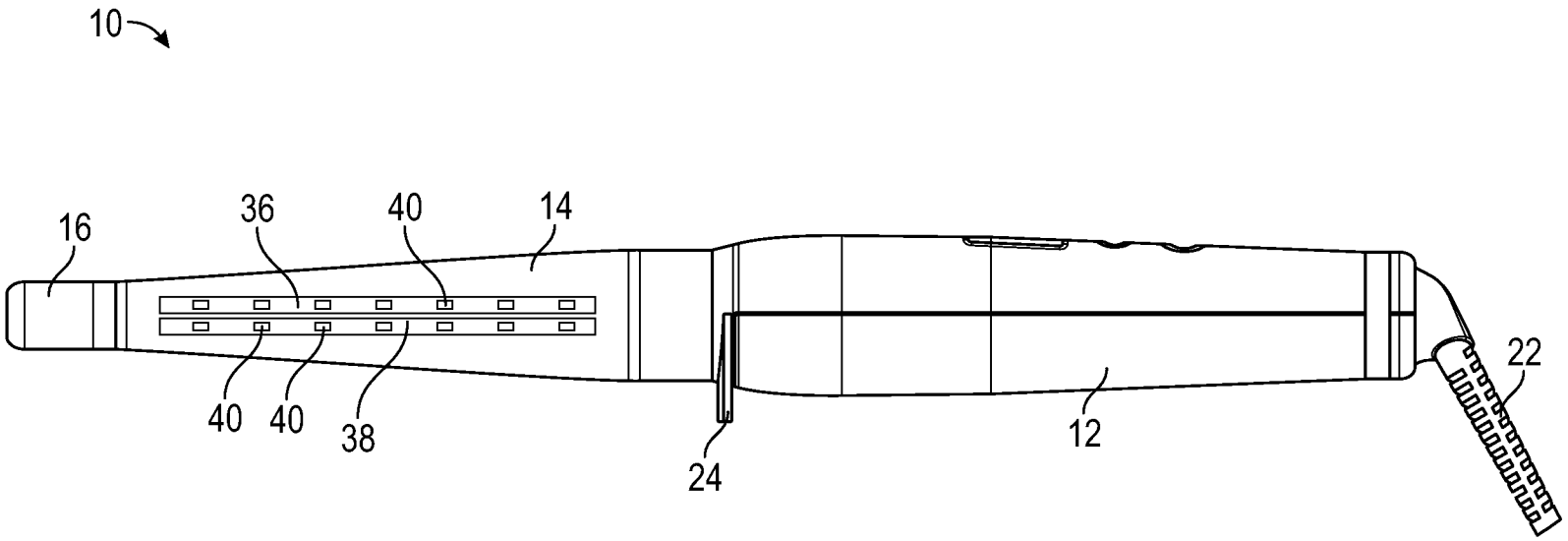
FIG. 7 is a side elevational view of the hair styling iron of FIG. 1, showing the location and orientation of the light emitting elements.

As further shown in FIGS. 1-4, in an embodiment, the handle 12 may be formed form a pair of opposed and interconnected housing members 18, 20. A power supply or power cord 22 is connected the handle 12 opposite the mandrel 14 to provide electrical power to the hair styling iron 10. The power cord 22 is configured to engage a suitable electrical outlet (e.g., a wall outlet, etc.). However, in other embodiments, any suitable source of electricity may be incorporated into the hair styling iron 10, including, but not limited to a battery or rechargeable battery. In an embodiment, the power cord 22 is mounted to a hub 32 that is rotatable with respect to the housing or handle 12 to provide for better ergonomics. In connection with this feature, and as shown in FIG. 4, the handle 12 encloses a strain relief member 34. The hair styling iron may further include a foot or stand 24 connected to the underside of the distal end of the handle 12 which supports the mandrel 14 in an elevated position when placed atop a surface such as a countertop.

Figure 2:
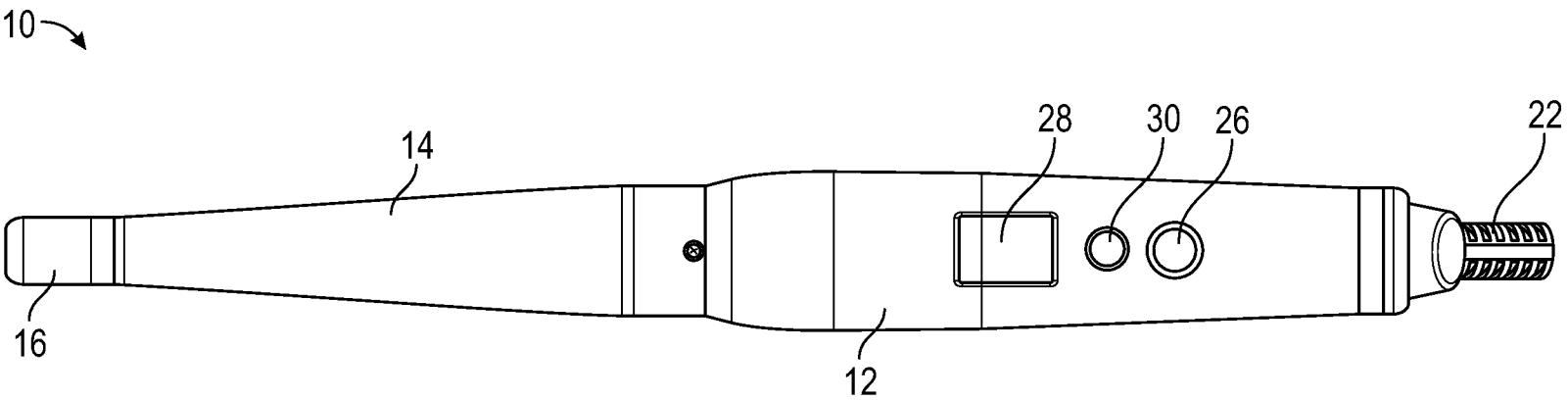
FIG. 2 is a top plan view of the hair styling iron of FIG. 1.
Figure 3:
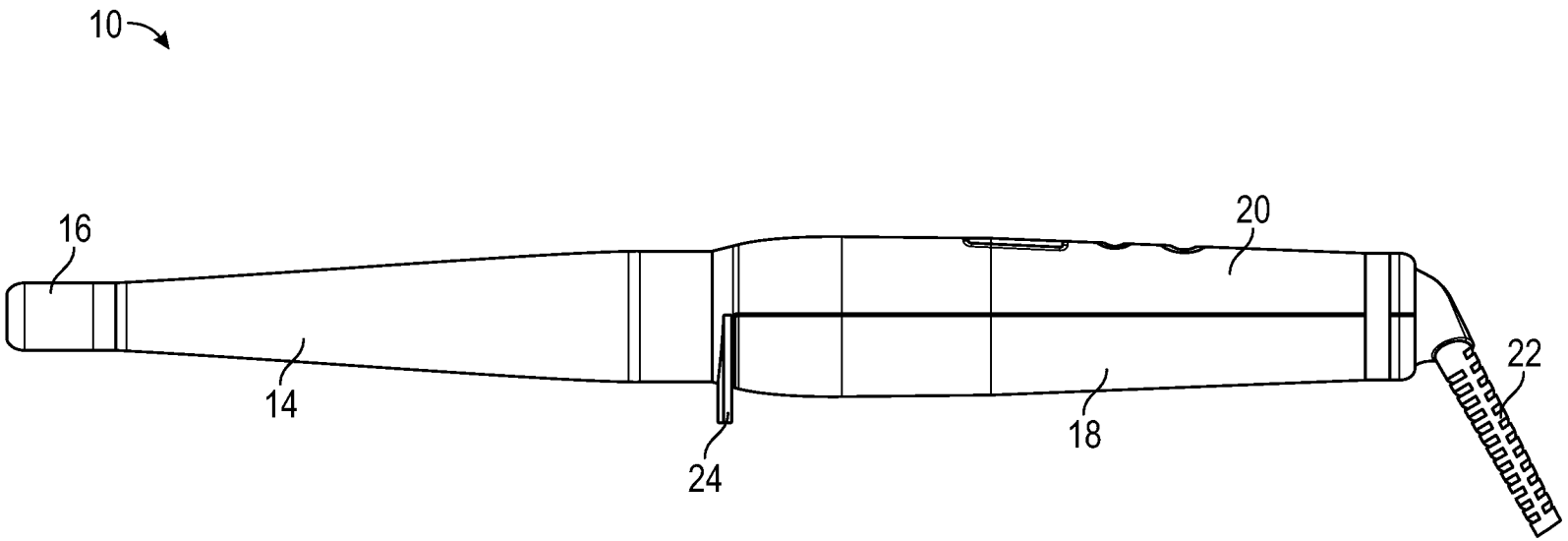
FIG. 3 is a side elevational view of the hair styling iron of FIG. 1.

As best shown in FIG. 2, the hair styling iron 10 also includes an interface including a plurality of visual indicators and user controls for controlling operation of the hair styling iron. For example, in an embodiment, the hair styling iron 10 may include a power button 26 for turning ON and OFF the device, a LCD or other screen 28 providing a visual indication to a user of the temperature of the mandrel 14, as well as a button 30 that is utilized to selectively increase the temperature of the mandrel 14.

With specific reference to FIG. 4-7, in an embodiment, the hair styling iron 10 includes at least one, and preferably a pair of parallel strips 36, 38 having a plurality of radiation and/or light emitting elements 40 thereon. In the preferred embodiment, the light emitting elements 40 are light emitting diodes configured to emit red or infrared light/radiation. In an embodiment, the light emitting elements 40 are configured to emit light having a wavelength between about 620 to about 750 nm. The strips 36, 38 are mounted within the mandrel 14, as shown therein. Accordingly, as illustrated in FIGS. 4-7, the hair styling iron 10 includes a pair of linear arrays of light emitting elements 40.

In use, upon energization of the hair styling iron 10 by depressing the power switch 26, electricity is transmitted from the power cord 22 to the LEDs 40 on each of the strips 36,38. The LEDs emit infrared or red light/radiation as the case may be, which heats the mandrel 14. This heat is then imparted to hair that is wrapped around the mandrel 14 by conduction, as known in the art. In addition, because the mandrel 14 is radiation and/or light transmissive (e.g., formed from glass), the heat generated by the LEDs 40 is also permitted to directly heat the hair wrapped around the mandrel 14 by radiation. While FIGS. 4-7 disclose a pair of LED strips 36, 38 facing upwardly and downwardly, the orientation of the strips may be varied so as to, for example, emit light from the lateral sides of the mandrel 14. Moreover, while a pair of LED strips 36, 38 are shown, it is contemplated that more or fewer than two parallel strips may be employed.

It is further contemplated that the glass or other light transmissive material from which the mandrel 14 is made may be colored, so that the mandrel 14 is illuminated when the LEDs are energized. For example, in an embodiment, the mandrel 14 (or LEDs or light pipe) may be red in color so as to visually appear to be glowing red when the LEDs are energized. In another embodiment, color-changing LEDs may be utilized so that the color of the mandrel 14 appears to change during use.

Figure 8:
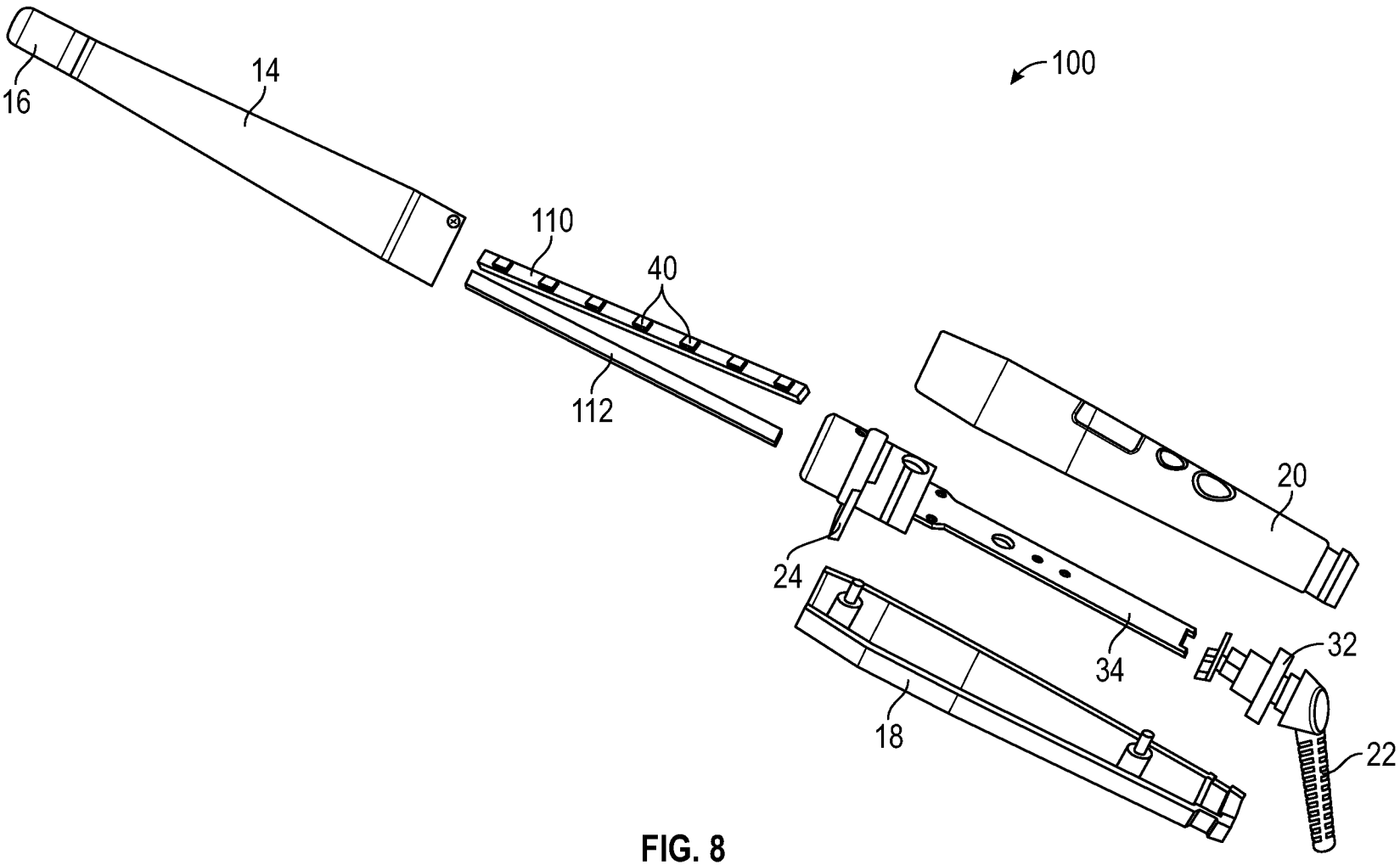
FIG. 8 is an exploded, perspective view a hair styling iron according to another embodiment of the invention.
Figure 9:
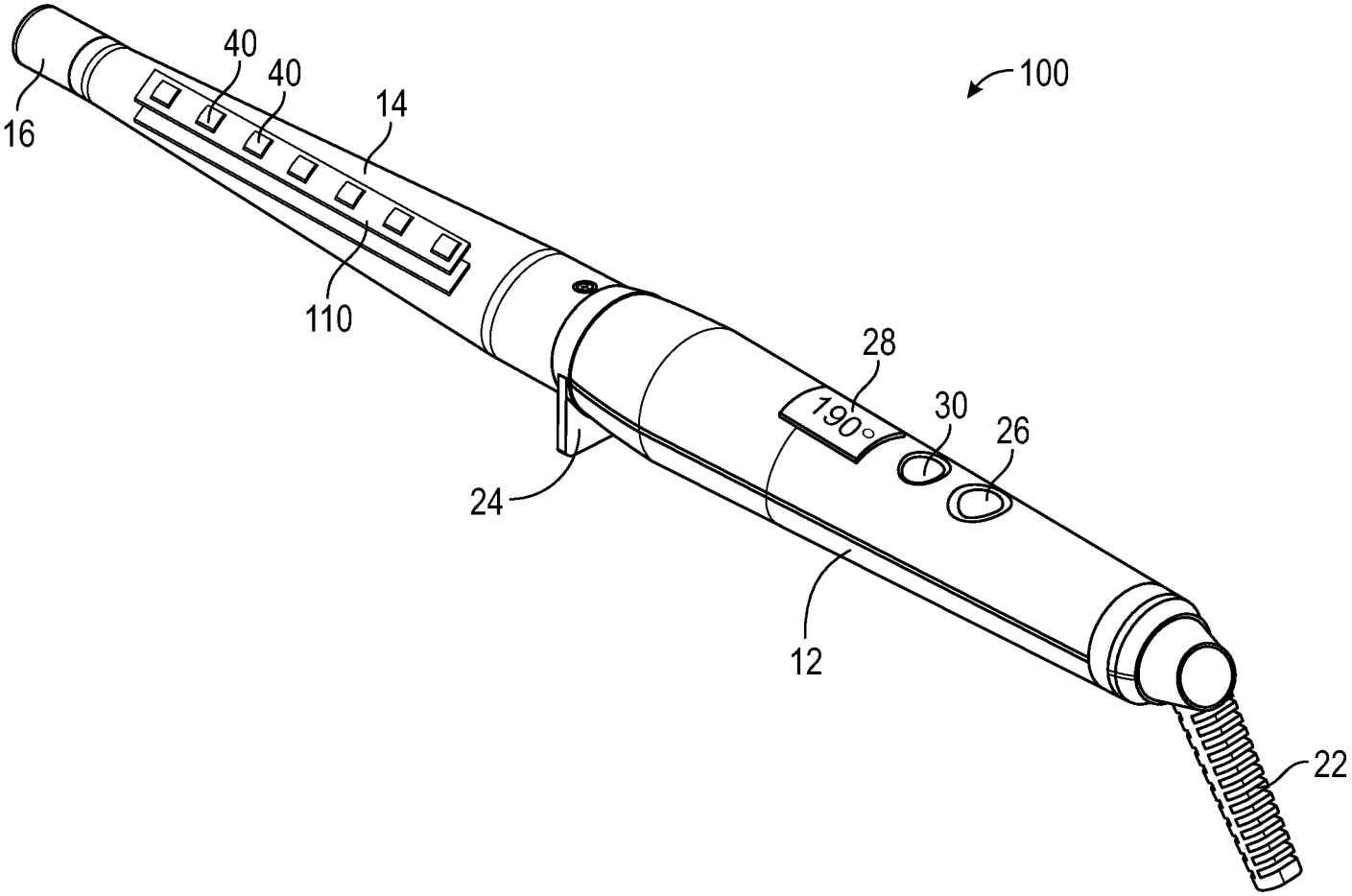
FIG. 9 is a rear, perspective view of the hair styling iron of FIG. 8, showing the location and orientation of the light emitting elements.
Figure 10:
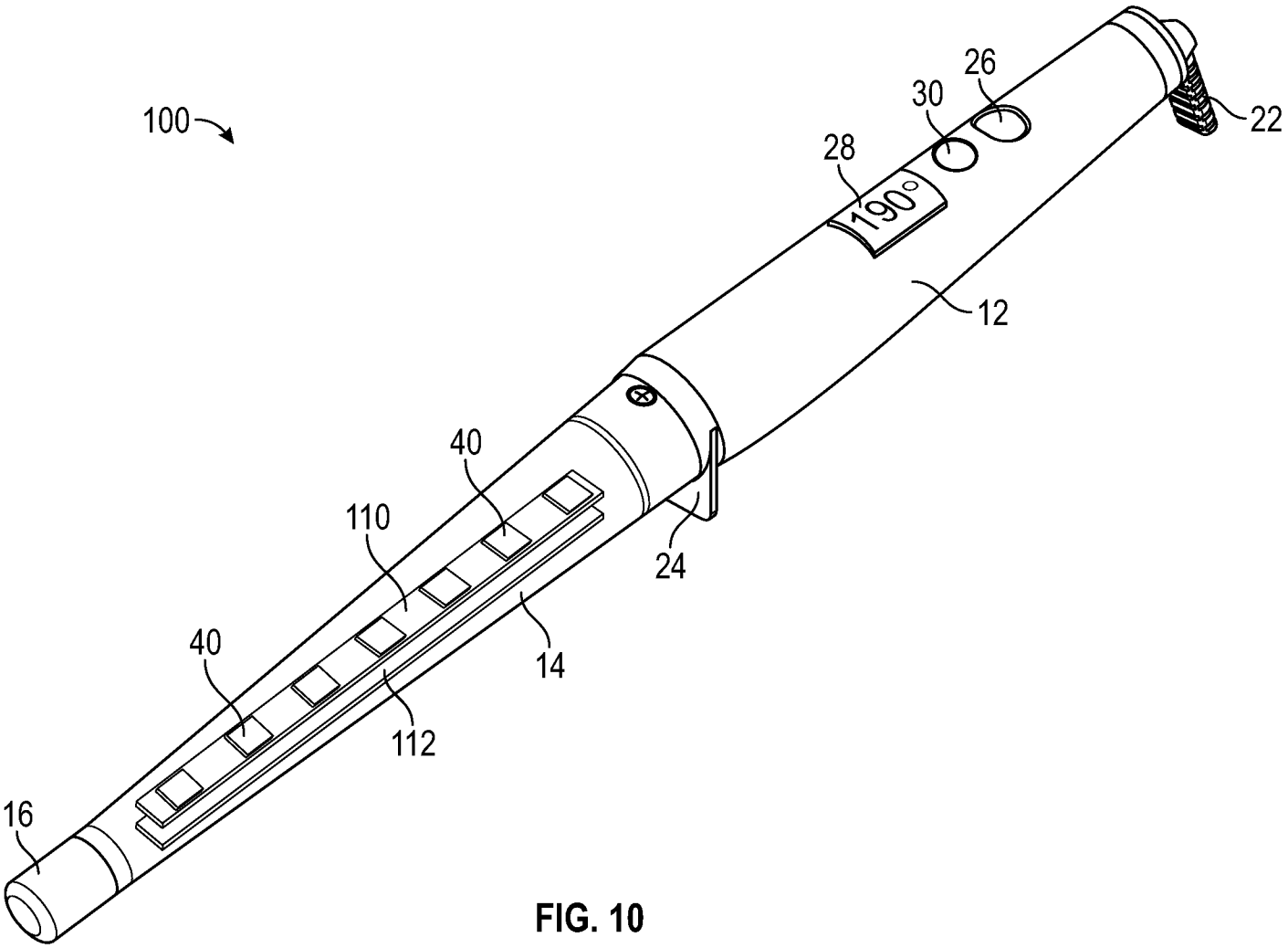
FIG. 10 is a front, perspective view of the hair styling iron of FIG. 8, showing the location and orientation of the light emitting elements.
Figure 11:
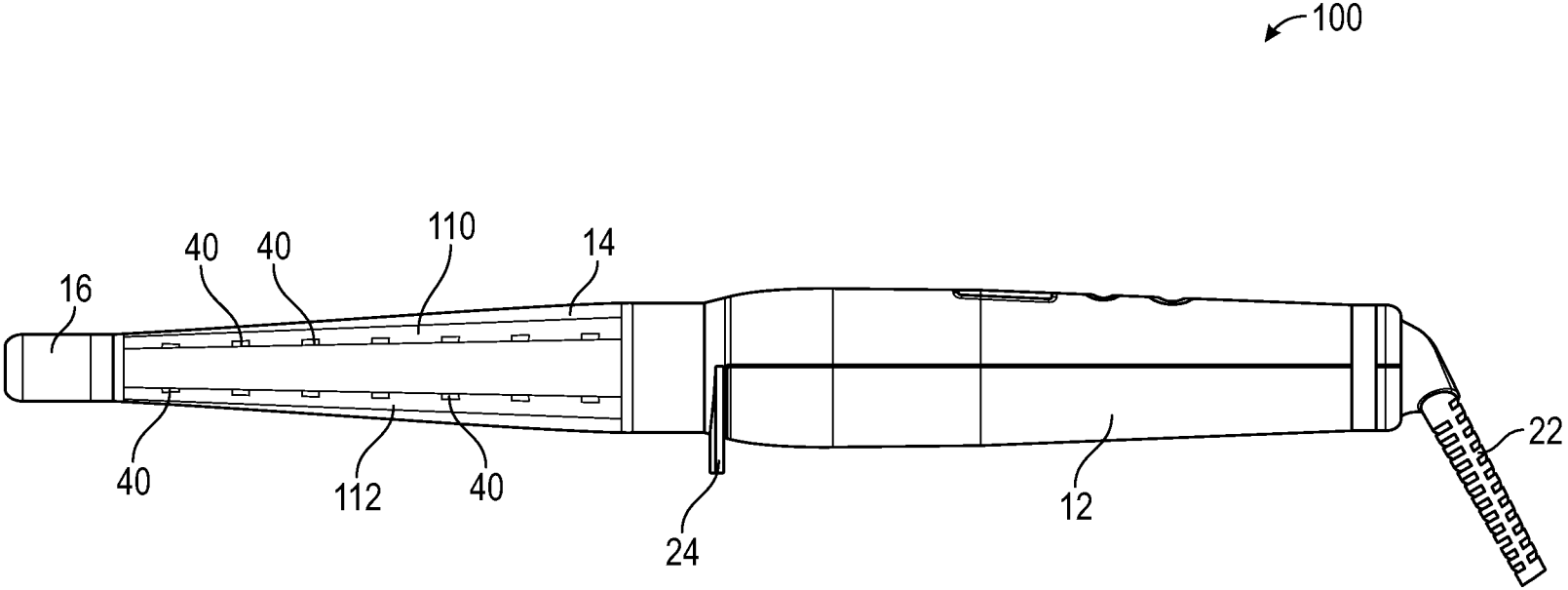
FIG. 11 is a side elevational view of the hair styling iron of FIG. 8, showing the location and orientation of the light emitting elements.
Figure 12:
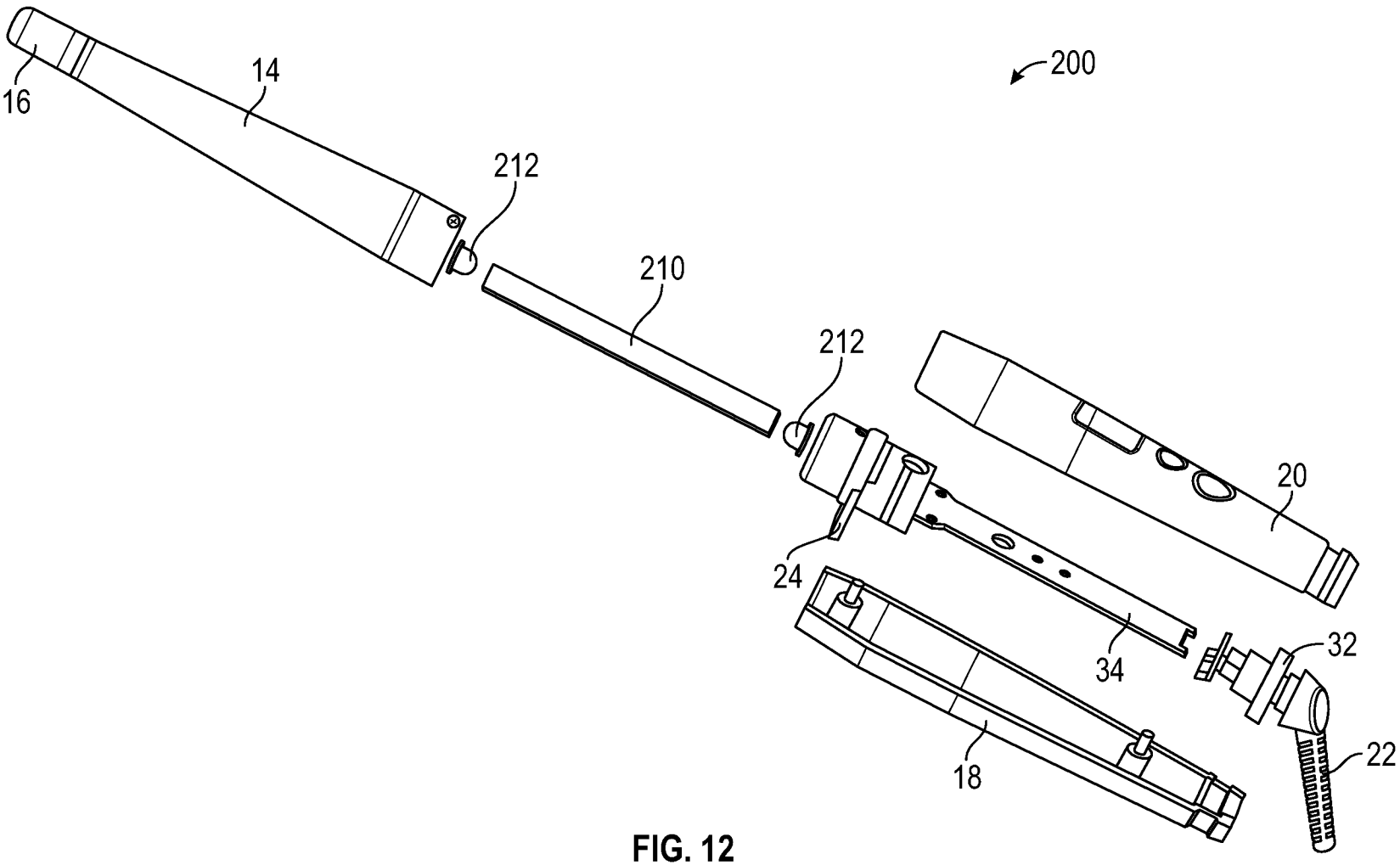
FIG. 12 is an exploded, perspective view a hair styling iron according to another embodiment of the invention.
Figure 13:
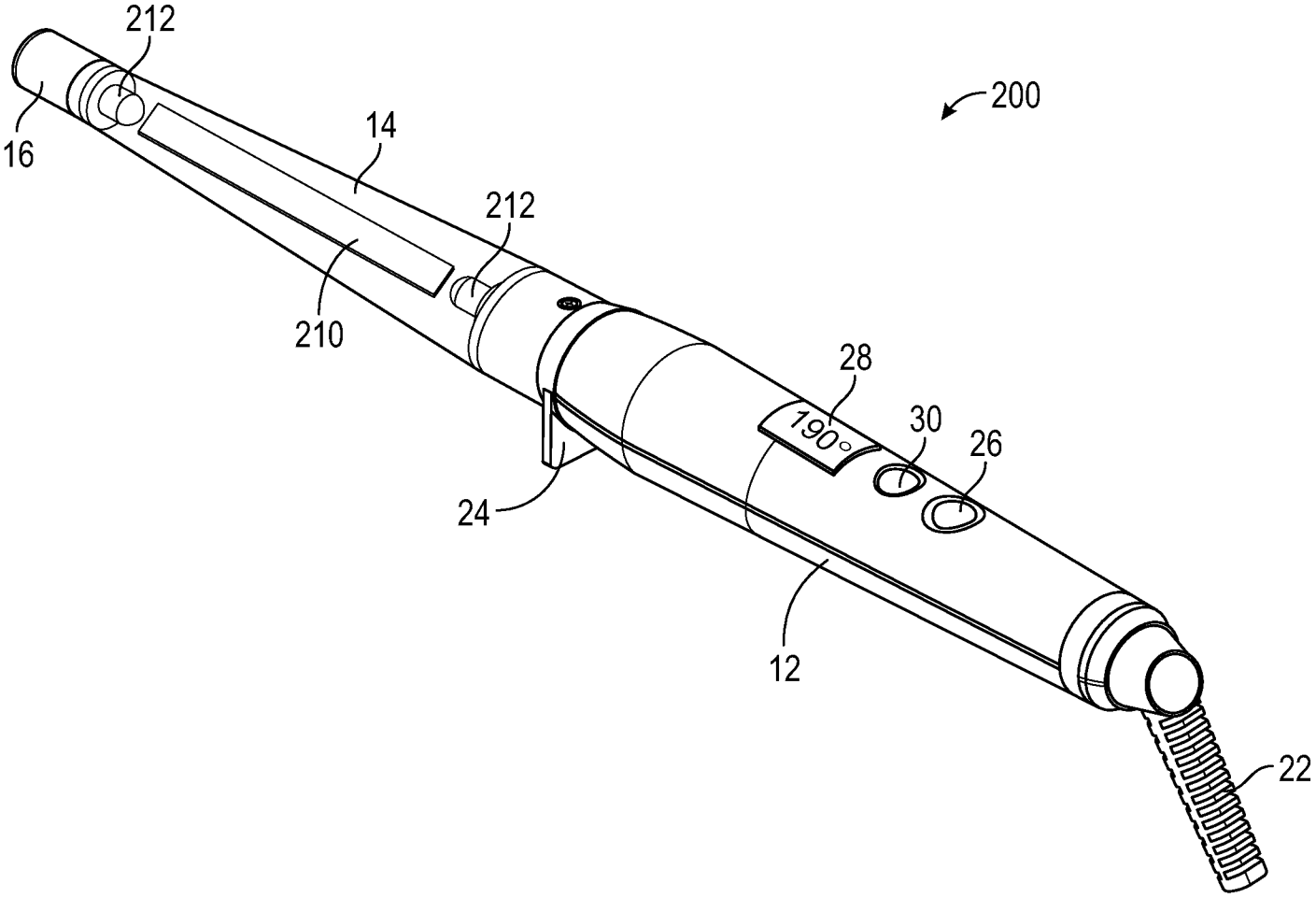
FIG. 13 is a rear, perspective view of the hair styling iron of FIG. 12, showing the location and orientation of the light emitting elements.
Figure 14:
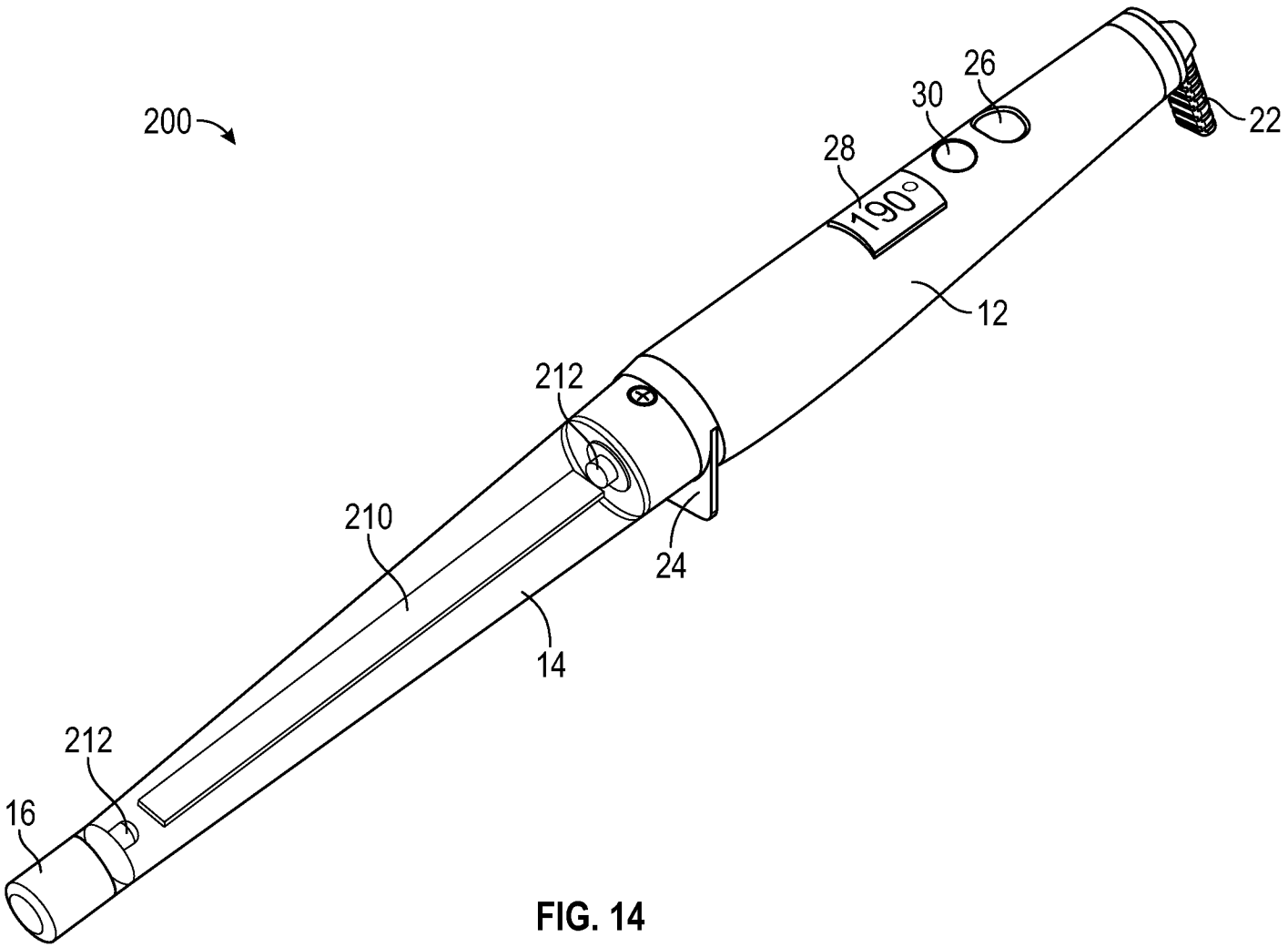
FIG. 14 is a front, perspective view of the hair styling iron of FIG. 12, showing the location and orientation of the light emitting elements.
Figure 15:
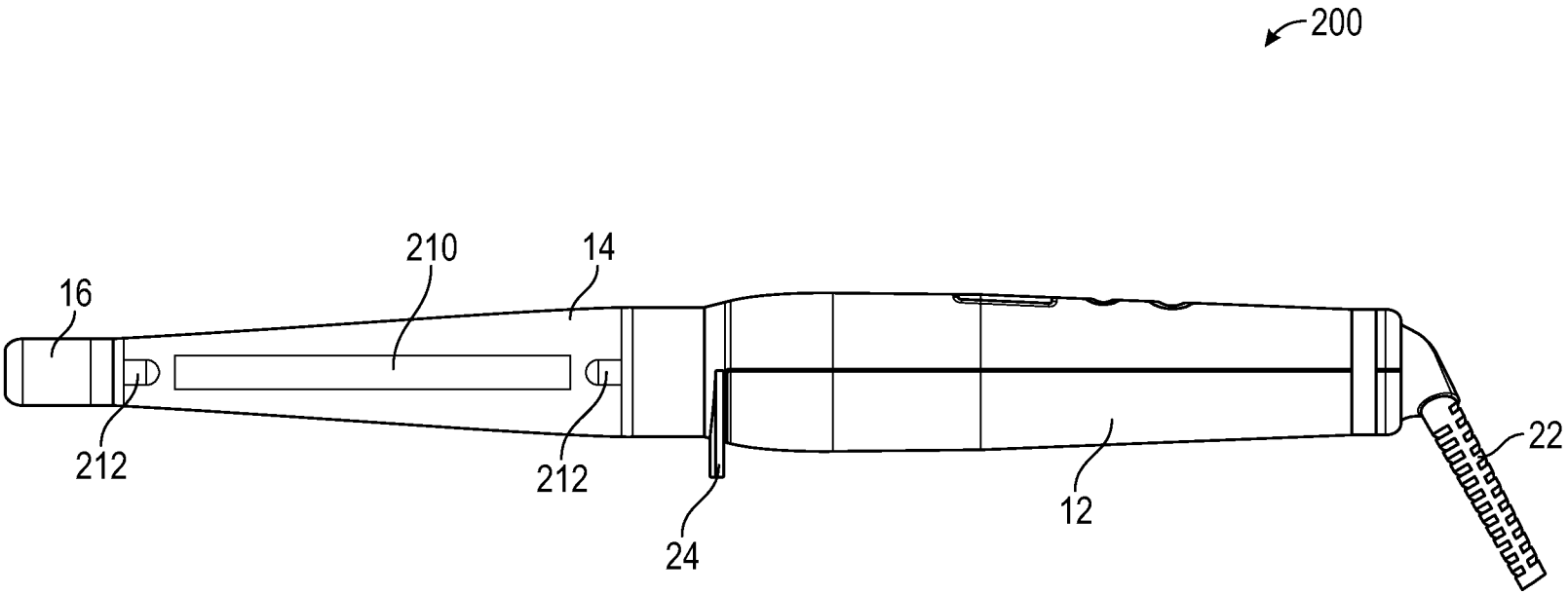
FIG. 15 is a side elevational view of the hair styling iron of FIG. 12, showing the location and orientation of the light emitting elements.

With reference to FIGS. 8-11, a hair styling iron 100 according to another embodiment of the present invention is shown. The hair styling iron 100 is similar to hair styling iron 10, where like reference numerals designate like parts. Rather than having two parallel strips of light emitting diodes, however, the hair styling iron 100 includes first and second strips 110, 112 having a plurality of infrared/red LEDs 40, wherein the strips 110, 112 are angled with respect to one another. For example, as best shown in FIGS. 8 and 11, the proximal ends of each strip 110, 112 are spaced apart from one another at a proximal end of the mandrel 14 and converge towards one another moving from the proximal end to the distal end of the mandrel 14. In an embodiment, the strips are oriented or angled so as to closely track or correspond to the shape or curvature of the outer surface of the mandrel. In particular, as shown in FIGS. 8-11, where the mandrel 14 is conical in shape, the strips 110, 112 are correspondingly angled such that each strip is generally parallel to the outer surface of the mandrel 14 nearest to which it is located. In an embodiment, the two strips may contact each other at the distal ends thereof. Moreover, while FIGS. 8-11 illustrate two non-parallel linear arrays of LEDs, in an embodiment, the hair styling iron 100 may include a single strip of LEDs that is bent to form a V-shape.

Similar to the embodiment of FIGS. 1-7, while FIGS. 8-11 disclose a pair of LED strips 110, 112 facing, generally, upwardly and downwardly, the orientation of the strips may be varied so as to, for example, emit light from the lateral sides of the mandrel 14. Moreover, while a pair of LED strips 110, 112 are shown, it is contemplated that more or fewer than two angled strips may be employed.

Turning finally to FIGS. 12-15, a hair styling iron 200 according to another embodiment of the present invention is shown. The hair styling iron 200 is similar to hair styling iron 10 and hair styling iron 100, where like reference numerals designate like parts. Rather than having light emitting elements, e.g., diodes, arranged in linear arrays (i.e., LEDs mounted on strips), the hair styling iron 200 includes a cylindrical light pipe or light tube 210 having a respective infrared or red LED 212 located at each end thereof, and configured to emit infrared or red light and/or radiation into the interior passage of the light pipe 210. In an embodiment, the light pipe 210, like the mandrel 14, is light and radiation transmissive. While two LEDs 212 are shown, more or fewer LEDs may be mounted within the light pipe 210.

In the embodiments disclosed above, it should be noted that the tip 16 is designed and configured to remain comparatively cool with respect to the mandrel 14, even when the light emitting element 40 are energized. For example, in an embodiment, the tip 16 may remain cool as a result of the LEDs 40 not being positioned within the tip 16 (i.e., the LEDs 40 are all located at a longitudinal location shy of the tip 16. In yet other embodiments, or in addition, the tip 16 may be maintained in a cool/non-heated state by providing insulating material deposited, painted or adhered to the tip 16 (e.g., on an outer surface of the tip 16 or between the LEDs 40 and the inner surface of the tip 16.

In connection with the above, the hair dryers disclosed herein may include a control unit and processor, and associated electrical connections and/or control circuitry necessary to carry out the functions described herein. It is contemplated, however, that more simple electrical and mechanical connections between the switches, buttons and LEDs may be used to carry out the functions described herein. Lastly, while the light emitting elements 40 are disclosed herein as being LEDs, it is contemplated that any light or radiation emitting elements capable of emitting infrared or red light known in the art may also be utilized without departing from the broader aspects of the invention.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A hair styling iron, comprising:
a housing;
a mandrel extending longitudinally from the housing, the mandrel having a proximal end adjacent to the housing, and a distal end opposite the proximal end; and
a plurality of light emitting elements within the mandrel, the plurality of light emitting elements being arranged in at least two linear arrays;
wherein the plurality of light emitting elements are light emitting diodes that emit light having a wavelength between about 620 to about 750 nm; and
wherein a cross-sectional area of the mandrel at the proximal end is greater than the cross-sectional area of the mandrel at the distal end;
wherein the mandrel is formed from glass and is both light and radiation transmissive over an entire circumferential outer surface of the mandrel.

2. The hair styling iron of claim 1, wherein:
the mandrel has a tapered or conical shape.

3. The hair styling iron of claim 1, further comprising:
a tip extending from the distal end of the mandrel.

4. The hair styling iron of claim 3, wherein:
the tip is painted or provided with an insulative material configured to inhibit heating of an exterior surface of the tip by radiation emitting elements positioned within the mandrel.

5. The hair styling iron of claim 1, wherein:
the at least two linear arrays are parallel, linear arrays.

6. The hair styling iron of claim 1, wherein:
the at least two linear arrays are non-parallel, linear arrays.

7. A hair styling iron, comprising:
a housing;
a mandrel extending longitudinally from the housing;
a first linear array of light emitting elements within the mandrel; and
a second linear array of light emitting elements within the mandrel;
wherein the first linear array and second linear array are parallel and arranged to emit light out of opposing sides of the mandrel away from one another and in opposite directions.

8. The hair styling iron of claim 7, wherein:
the mandrel is formed from a light and/or radiation transmissive material.

9. The hair styling iron of claim 8, wherein:
the mandrel is formed from glass.

10. The hair styling iron of claim 8, wherein:
the mandrel has a tapered or conical shape.

11. The hair styling iron of claim 8, wherein:
the mandrel is formed from glass; and
wherein the mandrel has a tapered or conical shape.

12. The hair styling iron of claim 11, wherein:
the light emitting elements are light emitting diodes that emit light having a wavelength between about 620 to about 750 nm.

13. A hair styling iron, comprising:
a housing;
a mandrel extending longitudinally from the housing;
a first linear array of light emitting elements within the mandrel; and
a second linear array of light emitting elements within the mandrel;
wherein the first linear array and second linear array are angled with respect to one another such that the first linear array and the second linear array are not parallel, and are arranged to emit light out of opposing sides of the mandrel away from one another and in opposite directions.

14. The hair styling iron of claim 13, wherein:
the first linear array of light emitting elements and the second linear array of light emitting elements are both mounted on a single strip bent into a V-shape.

15. The hair styling iron of claim 13, wherein:
the first linear array of light emitting elements and the second linear array of light emitting elements are mounted on first and second strips, respectively, that do not contact one another.

16. The hair styling iron of claim 13, wherein:
the first linear array of light emitting elements and the second linear array of light emitting elements are mounted at an angle that corresponds to a shape of an outer surface of the mandrel.

17. The hair styling iron of claim 16, wherein:
the outer surface of the mandrel has a conical or tapered shape.

18. The hair styling iron of claim 13, wherein:

the light emitting elements are light emitting diodes that emit light having a wavelength between about 620 to about 750 nm.

19. A hair styling iron, comprising:

a housing;

a mandrel extending longitudinally from the housing;

a light tube within the mandrel;

a first light emitting element positioned at a proximal end of the light tube and configured to emit light into the light tube;

a second light emitting element positioned at a distal end of the light tube and configured to emit light into the light tube; and wherein the light tube is devoid of light emitting elements intermediate the first light emitting element and the second light emitting element.

20. The hair styling iron of claim 19, wherein:

the light emitting elements are light emitting diodes that emit light having a wavelength between about 620 to about 750 nm.

* * * * *